US010281883B2

(12) United States Patent
Szini et al.

(10) Patent No.: US 10,281,883 B2
(45) Date of Patent: May 7, 2019

(54) WEARABLE ELECTRONIC DEVICE ADAPTED FOR SUPPORTING WIRELESS COMMUNICATIONS

(71) Applicant: Motorola Mobility LLC, Chicago, IL (US)

(72) Inventors: Istvan J. Szini, Grayslake, IL (US); Michael Russell, Lake Zurich, IL (US); Katherine Coles, Chicago, IL (US); Thomas Gitzinger, Libertyville, IL (US); Toshihiro Fujimura, Chicago, IL (US)

(73) Assignee: Motorola Mobility LLC, Chicago, IL (US)

( * ) Notice: Subject to any disclaimer, the term of this patent is extended or adjusted under 35 U.S.C. 154(b) by 42 days.

(21) Appl. No.: 15/385,687

(22) Filed: Dec. 20, 2016

(65) Prior Publication Data

US 2018/0173167 A1 Jun. 21, 2018

(51) Int. Cl.

| | |
|---|---|
| ***A44C 5/10*** | (2006.01) |
| ***G04B 37/12*** | (2006.01) |
| ***G04B 37/14*** | (2006.01) |
| ***G04R 60/04*** | (2013.01) |
| ***G04R 60/06*** | (2013.01) |
| ***G04R 60/10*** | (2013.01) |
| ***G04R 60/12*** | (2013.01) |

(52) U.S. Cl.

CPC ..... *G04R 60/06* (2013.01); *A44C 5/107* (2013.01); *G04B 37/12* (2013.01); *G04B 37/1486* (2013.01); *G04R 60/04* (2013.01); *G04R 60/10* (2013.01); *G04R 60/12* (2013.01)

(58) Field of Classification Search

CPC ..... G04R 60/02; G04R 60/04; G04R 60/08; G04R 60/10; G04R 60/12; A44C 5/105; A44C 5/147; G04B 3712/1486

See application file for complete search history.

(56) References Cited

U.S. PATENT DOCUMENTS 7,714,790 B1 * 5/2010 Feldstein ..... H01Q 1/007 343/702
9,141,089 B1 * 9/2015 Liou ..... G04R 60/14
(Continued)

OTHER PUBLICATIONS

Wu et al., Slot Antenna for All-Metal Smartwatch Applications, 2016 10th European Conference on Antennas and Propagation (EuCAP), pp. 1-4, Apr. 10-15, 2016.

*Primary Examiner* — Daniel P Wicklund
(74) *Attorney, Agent, or Firm* — Lawrence J. Chapa

(57) ABSTRACT

A wearable electronic device includes a conductive housing, which has a main body and at least a first pair of conductive lugs external to and mechanically coupled to the main body. The main body of the conductive housing forms at least part of an antenna structure that is adapted for at least one of generating or receiving the wireless radio frequency signal. The wearable electronic device further includes a non-conductive pin, which extends between the ends of the conductive lugs, and a use location attachment. The use location attachment includes a plurality of segments, where at least one of the segments, which most closely mechanically couples to the non-conductive pin and the first pair of conductive lugs, is nonconductive, and where other ones of the plurality of segments of the use location attachment are conductive.

17 Claims, 6 Drawing Sheets

(56) References Cited

U.S. PATENT DOCUMENTS

| | | | | |
|---|---|---|---|---|
| 9,612,582 | B1 * | 4/2017 | Wang | G04G 17/04 |
| 2004/0222930 | A1 * | 11/2004 | Sun | A44C 5/0007 343/718 |
| 2009/0113870 | A1 * | 5/2009 | Rejzner | A44C 5/107 59/80 |
| 2011/0241948 | A1 * | 10/2011 | Bevelacqua | H01Q 1/243 343/702 |
| 2012/0069720 | A1 * | 3/2012 | Catheline | A44C 5/107 368/282 |
| 2013/0152542 | A1 * | 6/2013 | Kaltenrieder | A44C 5/185 59/82 |
| 2014/0354494 | A1 * | 12/2014 | Katz | H01Q 1/273 343/718 |
| 2015/0003217 | A1 * | 1/2015 | Leoni | A44C 5/18 368/282 |
| 2015/0349410 | A1 * | 12/2015 | Russell | H01Q 1/273 343/702 |
| 2015/0378321 | A1 | 12/2015 | Fraser et al. | |
| 2016/0006110 | A1 * | 1/2016 | Jain | H01Q 5/328 343/702 |
| 2016/0037875 | A1 * | 2/2016 | Rohrbach | G04B 37/1486 224/267 |
| 2017/0315584 | A1 * | 11/2017 | Lee | G06F 1/163 |
| 2018/0107168 | A1 * | 4/2018 | Han | G04G 17/02 |

* cited by examiner

WEARABLE ELECTRONIC DEVICE ADAPTED FOR SUPPORTING WIRELESS COMMUNICATIONS

FIELD OF THE INVENTION

The present invention relates generally to a use location attachment, such as a band, which attaches to a wearable electronic device, and more particularly, to a use location attachment which attaches to the housing of the wearable electronic device via one or more sets of lugs.

BACKGROUND OF THE INVENTION

The incorporation of data communications including wireless communications into a greater number of devices has enabled the extension of computing networks and corresponding connectivity beyond the more traditional computing type devices into a space including an Internet of Things, as well as various smart wearable type devices. In turn, access to the various connected devices has been made more convenient through an extension of methods and forms of interfacing with the connected devices through already commonly worn wearable type devices, that are beginning to be able to go beyond themselves and interface more directly with other nearby devices. At least a couple examples of wearable devices, that are increasingly able to go beyond themselves and interface more directly with other nearby devices include smart watches, activity trackers, smart glasses, wireless headsets, as well as medical monitoring/control/assist devices, such as hearing aids and wearable heart rate monitors.

For at least some wearable type devices, size, fit, and style can be an important consideration. For example, for at least some users from a style perspective, the type of material used for a watch can be an important factor. More specifically, for at least some users there can be a preference for an exemplary wearable electronic device, such as a smart watch, having a body and a use location attachment, such as a watchband, which is made to include conductive materials having a high perception of quality, such as metal and/or to have a metal finish. However, a conductive material and/or finish associated with a watch body and/or band can have an impact on wireless communication capabilities, that have been incorporated into the device. A conductive housing body can limit the use of internal antennas, as the conductive housing can have an impact on radiated signals attempting to enter or exit the device. As such, many designs having a conductive body attempt to incorporate the antenna structure into the body of the device.

However, in such instances, nearby metal structures can also continue to have a variable effect on the performance of an incorporated radiating structure, such as an antenna. For example, a metal wrist band to the extent that it can mechanically and/or electromagnetically couple to other nearby conductive structures can produce a variable effect that can negatively impact a nearby radiating structure that might be difficult to overcome and/or accommodate.

Metal structures for the housing of a wearable type device, can also provide additional structural strength, while reducing the volume of material needed to provide support for the desired structure. Smart wearable devices will often require additional electronic components, power storage and interface elements to support the additional functionality. As such, better management of the structural design can help control the overall size of the device. In at least some cases, such as in the case of a watch, moving the attachment point for a watch band to outside of the body of the watch can also free up additional internal space for the placement of elements which are helpful in supporting the additional and/or expanded functionality of the device. In addition, in at least some cases, moving the attachment point for a watch band to outside of the body of the watch also can enable the device to become more adjustable. A set of lugs can be used to create an external connection point for a use location attachment, such as a watch band. Having the watchband pivot externally relative to the watch case, such as around lugs can allow the watch to fit more tightly around a small wrist person, and/or more generously around a large wrist person. For at least some users, from a fit perspective, having a size adjustable device that performs well is important for comfort, such as when wearing the device for extended use.

In at least some instances, the lugs will be integrated as part of the body of the wearable type device. If the body is made from a conductive material, such as a metal, then the integrated lugs will often similarly be formed from the same conductive material. In turn, it will be helpful for these conductive structural elements to be accommodated in connection with supporting any nearby radiating structures used in support of wireless communications.

The present inventors have recognized that in connection with incorporating conductive and/or metal structures in a wearable type device, it can be beneficial to be able to limit and/or be able to better manage any electrical and/or electromagnetic coupling between the wearable device and the structure used to couple the wearable device to its use position, such as the device's intended use location on the body of the user.

SUMMARY OF THE INVENTION

The present invention provides a wearable electronic device adapted for supporting wireless radio frequency communications including at least one of generating or receiving a wireless radio frequency signal. The wearable electronic device includes a conductive housing, which has a main body and at least a first pair of conductive lugs external to and mechanically coupled to the main body. Each of the conductive lugs has a first end that is mechanically coupled to the main body of the conductive housing and a second end which extends away from the main body along a length of the conductive lug. The main body of the conductive housing forms at least part of an antenna structure that is adapted for at least one of generating or receiving the wireless radio frequency signal. The wearable electronic device further includes a non-conductive pin, which extends between the second ends of the first pair of conductive lugs, and a use location attachment. The use location attachment mechanically couples the conductive housing of the wearable electronic device to a use location via the non-conductive pin and the first pair of conductive lugs. The use location attachment includes a plurality of segments, where at least one of the segments, which most closely mechanically couples to the non-conductive pin and the first pair of conductive lugs, is nonconductive, and where other ones of the plurality of segments of the use location attachment are conductive.

In at least one embodiment, the length of the lugs is of a sufficient distance to form a gap between the main body of the conductive housing and the segment of the plurality of segments of the use location attachment, which most closely mechanically couples to the non-conductive pin and the first pair of conductive lugs.

In at least a further embodiment, each link includes a pair of side lobes separated by a cross member, where, in at least some instances, the cross member of the link, which most closely mechanically couples to the non-conductive pin and the first pair of conductive lugs, is non-conductive and includes a metalized surface, and the side lobes of the non-conductive link have a width, which is adapted to reduce an amount that the associated cross member with the metalized surface will electromagnetically coupling to the first pair of conductive lugs.

In at least a still further embodiment, the non-conductive pin is received within a hole, which extends through the segment of the plurality of segments of the use location attachment, which most closely mechanically couples to the non-conductive pin and the first pair of conductive lugs. The hole that receives the non-conductive pin extends through the associated side lobes of the segment most closely mechanically coupled to the non-conductive pin and the first pair of conductive lugs, as well as the associated cross member. The side lobes associated with the segment most closely mechanically coupled to the non-conductive pin and the first pair of conductive lugs each have a portion, which overhangs the associated cross member, and which partially overlaps a cross member of an adjacent segment in the plurality of segments of the use location attachment, that is further away from the first pair of conductive lugs, where a segment coupling pin extends through a cross member of the adjacent segment that is further away from the first pair of conductive lugs, and the overhang portion of the side lobes of the segment most closely mechanically coupled to the non-conductive pin and the first pair of conductive lugs through a separate set of holes in the overhang portion of the side lobes. The hole in the segment most closely mechanically coupled to the non-conductive pin and the first pair of conductive lugs, that receives the non-conductive pin, and the separate set of holes in the overhang portion of the side lobes for receiving the segment coupling pin are spaced a distance that precludes the cross member of the segment of the use location attachment, which most closely mechanically couples to the non-conductive pin and the first pair of conductive lugs, and the cross member of the adjacent segment that is further away from the first pair of conductive lugs from coming into direct physical contact.

These and other objects, features, and advantages of this invention are evident from the following description of one or more preferred embodiments of this invention, with reference to the accompanying drawings.

DETAILED DESCRIPTION OF THE PREFERRED EMBODIMENT(S)

Figure 1:
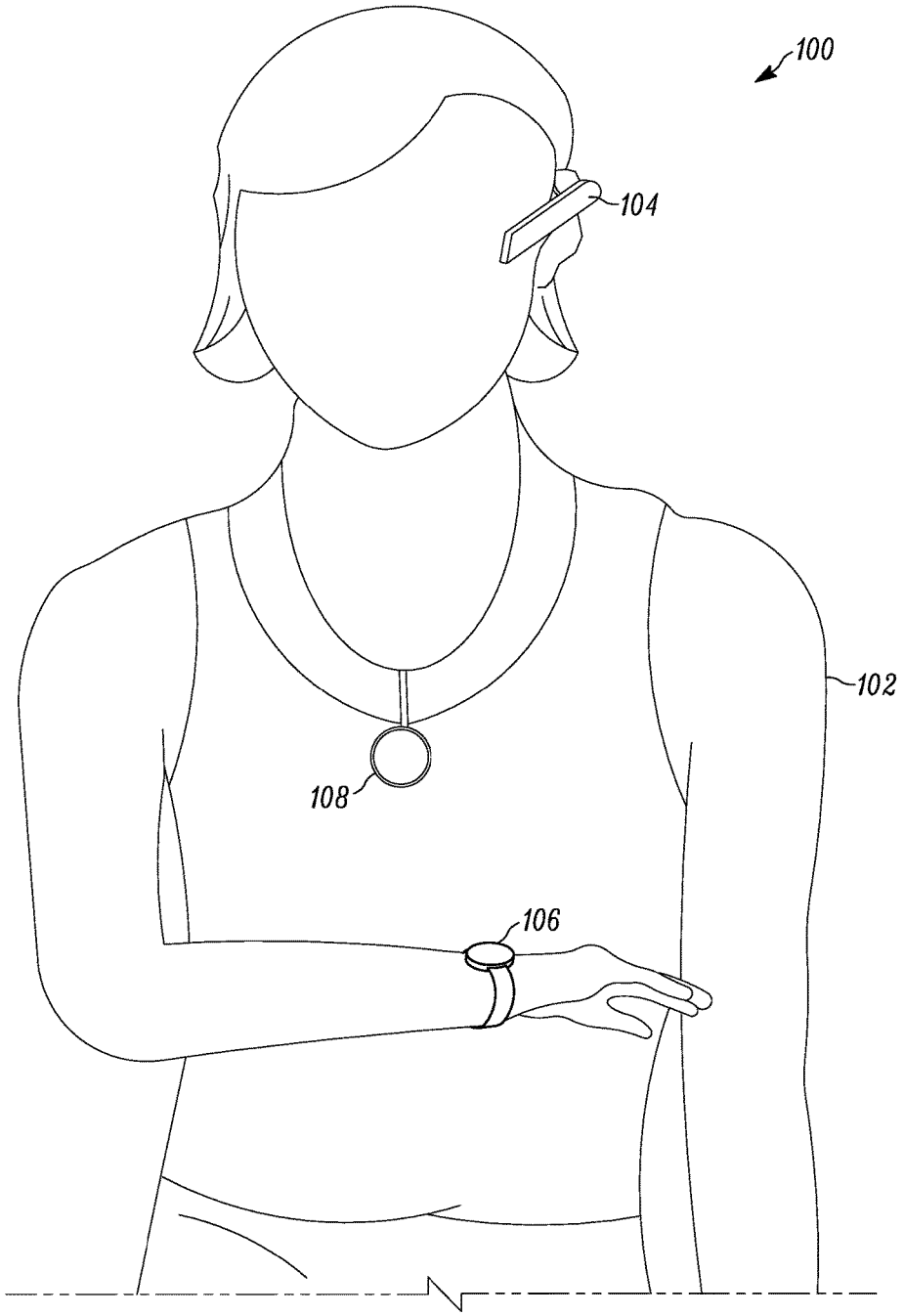
FIG. 1 is a view of one or more exemplary wearable electronic devices being worn by a person.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. One skilled in the art will hopefully appreciate that the elements in the drawings are illustrated for simplicity and clarity and have not necessarily been drawn to scale. For example, the dimensions of some of the elements in the drawings may be exaggerated relative to other elements with the intent to help improve understanding of the aspects of the embodiments being illustrated and described.

As mentioned previously examples of wearable devices, which are increasingly going beyond their more traditional functionality and are interfacing more directly with other nearby devices include smart watches, activity trackers, smart glasses, wireless headsets, as well as medical monitoring/control/assist devices, such as hearing aids and wearable heart rate monitors. The incorporation of various forms of wireless communication capabilities, which can interact with other devices in addition to more directly with a communication network, allows the wearable device to at least some times extend the user interface of the other device to the device being worn. This can sometimes make interacting with the features of the other device more convenient, but in turn can also make more relevant the ability of the wearable device to more reliably support wireless communications.

FIG. 1 illustrates a view 100 of one or more exemplary wearable electronic devices, which incorporate wireless communications, being worn by a person 102. For example, the wearable electronic devices can include a wireless headset 104, a smart watch 106, or a remote medical monitor/control/assist device 108. Generally, each of the devices include features which allow the device to attach to the person 102. For example, the devices might include a clip, so that it can be attached to the user, such as the user's ear. Alternatively and/or additionally, the device might include a band or a chain, which can be used to encircle a part of the user, such as a user's wrist or neck.

As further noted previously, there is a desire for at least some of these devices to support conductive bodies, as well as conductive forms of attachment to a human body, where the conductive forms can sometimes include the use of metals, which can at least sometimes be one or both more aesthetically desirable and/or more structurally durable. However the merging of wireless communications, with a greater use of conductive materials in the body of the devices as well as the forms of user attachment can present challenges relative to the reliability of wireless communications. This has often resulted in antenna designs, which have been incorporated into the conductive structures, which can often benefit from the radiating structures of the antenna being sometimes isolated from some of the other conductive structures, in order that the radiating structure and any nearby impacting elements remain predictable and well defined in the various anticipated use configurations.

Figure 2:
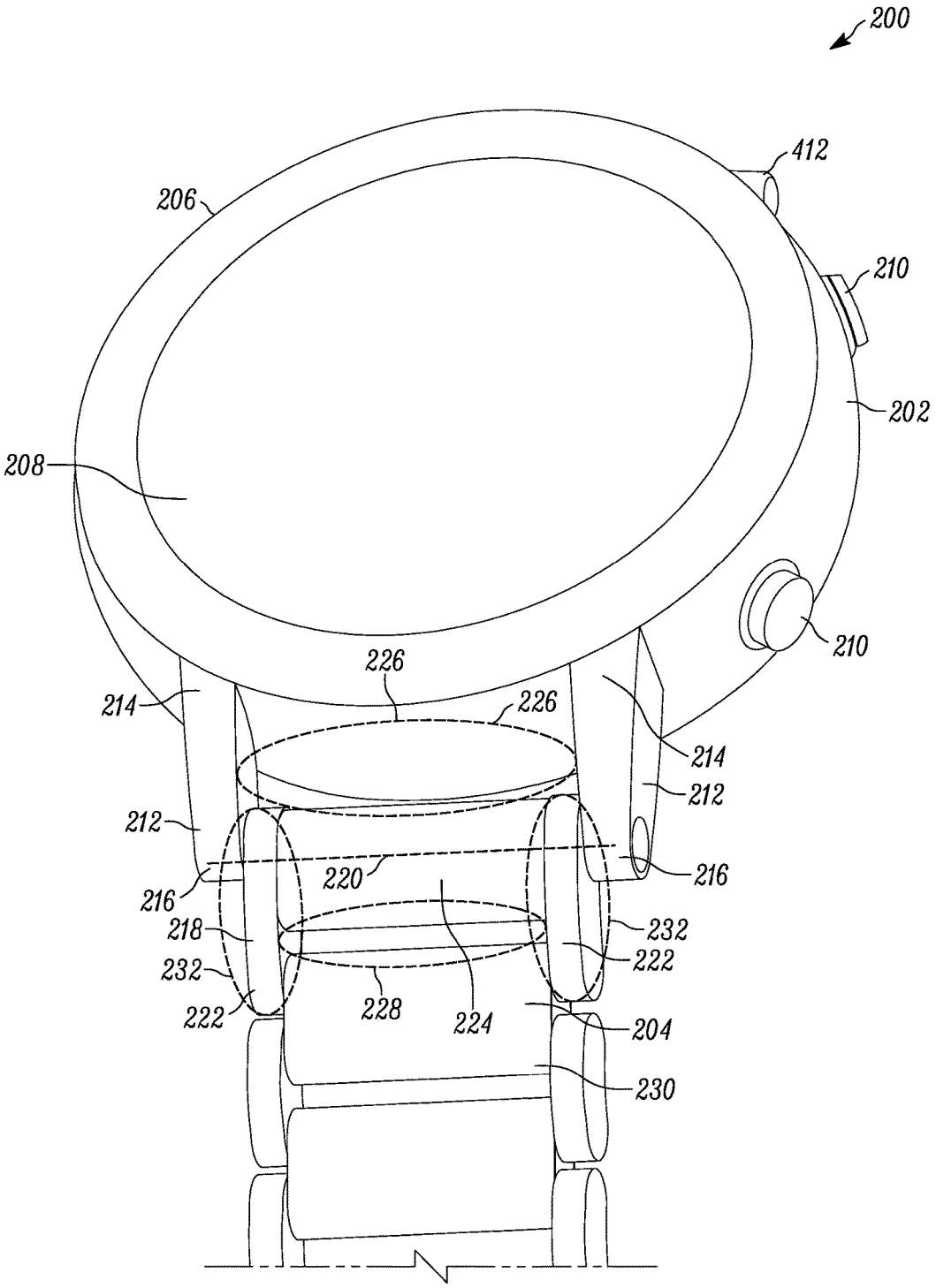
FIG. 2 is a partial perspective view of a wearable electronic device including a smart watch.

FIG. 2 illustrates a partial perspective view 200 of a wearable electronic device including a smart watch 206. The wearable electronic device includes a conductive housing 202, and a use location attachment 204, such as a wrist band. In the illustrated embodiment, the smart watch 206 includes a conductive housing 202 within which a radiating structure, namely an antenna, for supporting wireless communications can be formed. The conductive housing 202 further includes user interface elements, such as a watch face 208 in the form of an electronic display upon which information can be presented to the user 102. The electronic display in at least some instances can include a touch sensitive matrix via which the user 102 can interact with displayed elements for providing input to the device from the user 102. The user interface elements additionally include a pair of user actuatable buttons 210 on the side of the housing 202. The conductive housing 202 still further includes at least a first pair of conductive lugs 212, which are external to and mechanically coupled to the main body of the conductive housing 202. In the particular embodiment illustrated, the conductive lugs 212 are integrally formed as part of the main body.

Each of the conductive lugs 212, generally includes two ends, a first end 214 that is mechanically coupled to the main body of the conductive housing 202, and a second end 216, which extends away from the main body a distance corresponding to the length of the lug 212. By extending away from the main body of the conductive housing 202, the structure which allows the wrist band to couple to the main body can be external to the main body. This allows for space internal to the main body to be conserved for use by other elements, which support the intended functionality of wearable electronic device, such as electronic circuitry, power storage, and/or interface elements. Because the lugs 212 are conductive and are mechanically coupled to the conductive housing 202, electrical currents which flow through the conductive housing can also flow into and along the length of the conductive lugs 212, as well as any other conductive element that comes into contact with the conductive lugs.

In at least some instances, there is a desire to support a largely conductive use location attachment 204, i.e. wristband. In the illustrated embodiment, the wristband mechanically couples to the main body of the conductive housing 202 via the at least first pair of conductive lugs 212. Furthermore, the use location attachment 204, i.e. wristband, includes a plurality of segments, which are arranged end to end in sequence to form an overall length of elements generally following a single path. In the illustrated embodiment, where the use location attachment 204 is a wristband, at least some of the plurality of segments form links in the wristband.

The use location attachment 204 mechanically couples to the conductive lugs at at least one end, where while the use location attachment 204 generally includes a plurality of conductive segments arranged end to end, at least the segment 218, which most closely mechanically couples to the first pair of conductive lugs 212, is largely non-conductive. Furthermore, the segment 218, which most closely mechanically couples to the first pair of conductive lugs 212, is mechanically coupled to the first pair of conductive lugs 212 via a non-conductive pin 220, which extends between the second ends 216 of the first pair of conductive lugs 212. In at least the illustrated embodiment, the non-conductive pin 220 is received within a hole which extends through the segment 218, which most closely mechanically couples to the first pair of conductive lugs 212, and the first pair of conductive lugs 212.

In at least some instances, at least some of the segments includes two side lobes 222, separated by a cross member 224. In order to match an appearance more consistent with the segments of the use location attachment 204, which are largely formed from a conductive material, with the segment(s) 218 of the use location attachment 204, which are largely formed from a non-conductive material, the largely non-conductive segment(s) 218 can include a metalized outer surface. In at least some instances, the metalized outer surface can take the form of a conductive sleeve, which fits over the cross member 224. In at least some instances, the metalized outer surface can take the form of an applied metallization layer, such as a non-conductive vacuum metallization (NCVM) layer.

While a metalized outer surface, associated with at least the cross member of a non-conductive segment, such as the segment 218, which most closely mechanically couples to the first pair of conductive lugs 212, can help to provide a more uniform and/or pleasing metalized look to the use location attachment 204, i.e. wristband in the present embodiment, care is taken to isolate the conductive portions of the use location attachment 204 from the conductive housing 202. In the illustrated embodiment, such an isolation can include a space 226 between a cross member 224 having the metalized outer surface and the conductive housing 202; a space 228 between the cross member 224 having the metalized outer surface and a subsequent conductive segment 230; and a space 232 between the cross member 224 having the metalized outer surface and the conductive lugs 212.

In addition to addressing any direct mechanical coupling between the conductive elements of the conductive housing 202, and the conductive elements of the use location attachment 204, care may need to be taken to avoid any meaningful unintended electromagnetic coupling. By using a non-conductive pin 220, which extends between the second ends 216 of the first pair of conductive lugs 212 for mechanically coupling the use location attachment 204 to the conductive housing 202, and a largely non-conductive segment 218, a current loop from any surface currents and/or currents associated with any radiating structures, i.e. antennas, which might travel through the conductive structures extending around the space 226 can be reduced. In turn, the production of any corresponding electromagnetic energy will be reduced.

Increased isolation from the cross coupling of electromagnetic energy can be enhanced through a sufficiently large space 226 between the metalized outer surface of the cross member 224 of segment 218 and the conductive housing 202. The size of such a space can be managed through controlling the length of the lugs 212 between the first ends 214 and the second ends 216. Increased isolation from the cross coupling of electromagnetic energy can be further enhanced by including sufficient spacing between any metalized outer surface of the cross member 224 of segment 218, and a subsequent conductive segment in the use location attachment 204. Increased isolation from the cross coupling of electromagnetic energy can still further be enhanced by including sufficient spacing between any metalized outer surface of the cross member 224 and the at least first pair of lugs 212. Such a distance can be managed through control of the width of the associated side lobes 222 of the non-conductive segment 218.

Figure 3:
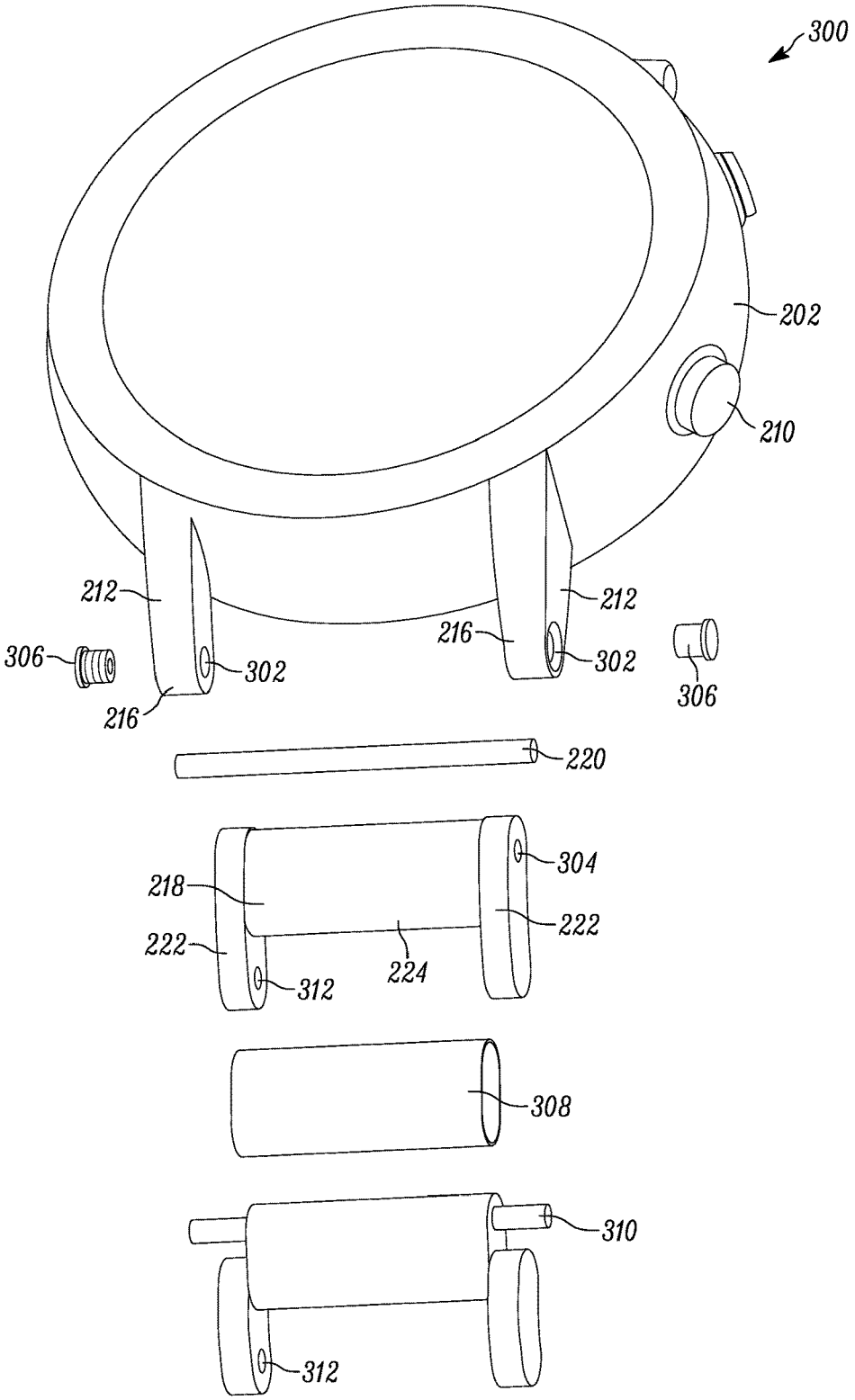
FIG. 3 is a partial exploded perspective view of the wearable electronic device including the smart watch illustrated in FIG. 2.

FIG. 3 illustrates a partial exploded perspective view 300 of the wearable electronic device including the smart watch 206, illustrated in FIG. 2. In the partial exploded perspective view 300, the non-conductive pin 220 is more clearly shown. The non-conductive pin 220 is adapted to extend through a hole 302 in each of the first pair of lugs 212 proximate the second end 216. The non-conductive pin 220 is further adapted to extend through a hole 304 in the cross member 224 of the segment 218 of the use location attachment 204, which most closely mechanically couples to the first pair of conductive lugs 212. In the illustrated embodiment, a pair of caps 306 can be used to close up at least one of the holes 302 in the lugs 212 after the non-conductive pin 220 has been inserted there through.

The partial exploded perspective view 300 further more clearly highlights a metalized outer surface of the cross member 224 in the form of a conductive sleeve 308, which can be used to wrap and/or extend around at least some of the non-conductive portions of the cross member 224. Still further, a subsequent segment of the use location attachment 204 can be mechanically coupled to an immediately prior segment in the sequence via a link coupling pin 310, which in at least some instance can be conductive. More specifically, the link coupling pin 310 can extend through a hole in the cross member of the subsequent segment, as well as respective holes 312 in the side lobes 222 of the immediately prior segment. Further adjacent segments in the sequence of segments of the use location attachment 204 can be similarly mechanically coupled together, so as to form a sequence of segments that includes a plurality of segments.

Figure 4:
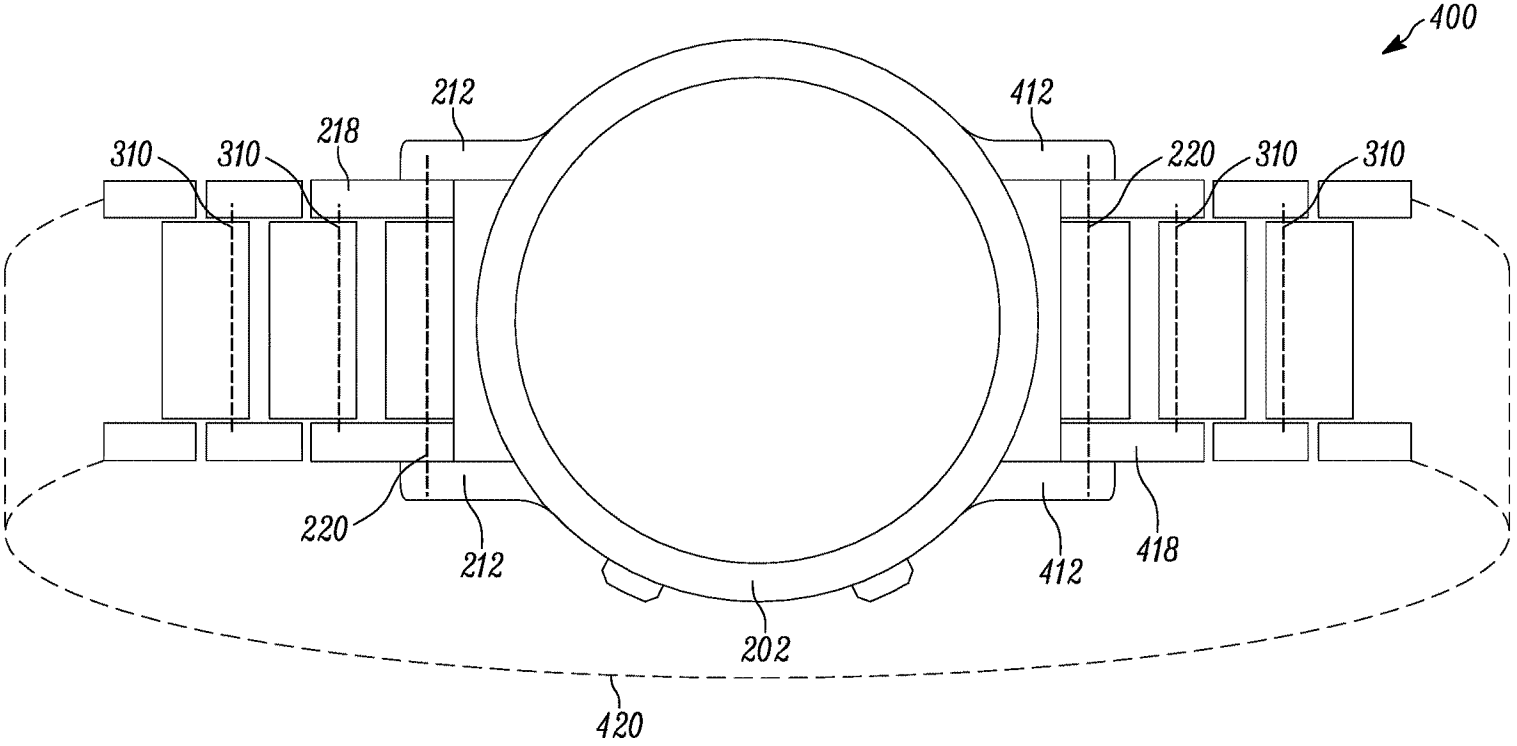
FIG. 4 is a partial front view of the wearable electronic device including the smart watch illustrated in FIGS. 2 and 3.

FIG. 4 illustrates a partial front view 400 of the wearable electronic device including the smart watch 206, illustrated in FIGS. 2 and 3. In the front view 400, the potential for a second pair of lugs 412 is more clearly illustrated, which can be used to mechanically couple another segment of the use location attachment to the conductive housing 202 of the main body of the wearable electronic device. In at least the illustrated embodiment, the further segment 418 that is most closely mechanically coupled to the second pair of lugs 412 is similarly likely to be non-conductive. Both the first and second pair of lugs 212 and 412 can be used to mechanically couple to opposite ends of the use location attachment, so as to form a loop 420. The formed loop 420 can be used to encapsulate a body part of a user 102, such as a user's wrist.

Along the length of the loop 420, a latch can be included that can allow the use location attachment 204 to be selectively opened or its length extended. By selectively opening or extending the loop 420, and then subsequently closing or shortening the loop 420, the loop can be made to traverse a wider element before the loop is again made to fit more snuggly at the intended use position, such as traversing over the wider hand before being fit more snuggly at or near the wrist of the user.

Figure 5:
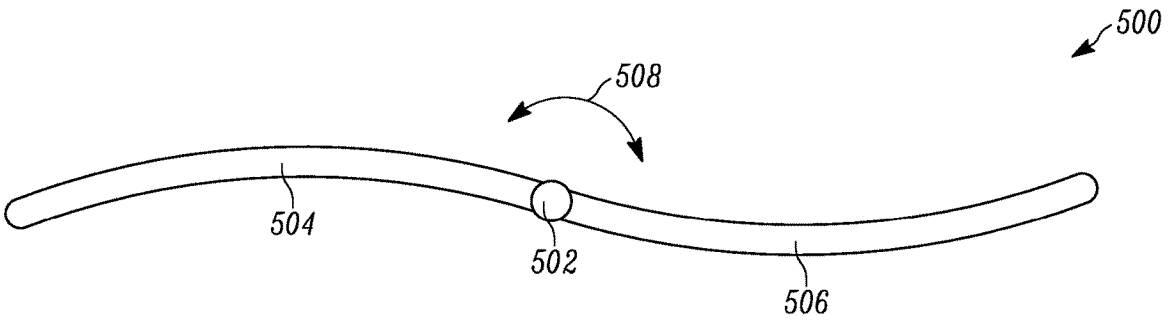
FIG. 5 is a side view of an exemplary oyster type clasp mechanism of a latch having a hinge.

FIG. 5 illustrates a side view of an exemplary oyster type clasp mechanism 500 of a latch, which has a hinge 502, so as to selectively extend or shorten the overall length of the loop 420. When the portion 504 on a first side of the hinge 502 is rotated about the hinge 502 so as to coincide with the portion 506 on the second side of the hinge 502, the clasp mechanism 500 can transition 508 the latch between an open and a closed position. While the mechanism has been described with a single hinge 502, other related mechanisms of a different type can include additional hinges.

Figure 6:
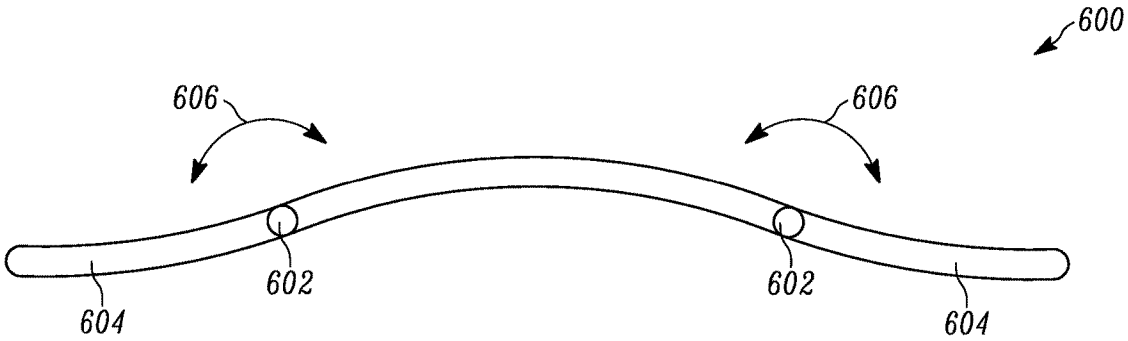
FIG. 6 is a side view of an exemplary butterfly type clasp mechanism of a latch having a pair of hinges.

FIG. 6 illustrates a side view of an exemplary butterfly type clasp mechanism 600 of a latch, which has a pair of hinges 602 with the principal difference relative to the oyster type clasp mechanism being the number of segments 604 that can rotate 606 between overlapping and non-overlapping positions. One skilled in the art will appreciate that still further configurations with the same or different number of hinges are possible without departing from the teachings of the present invention.

Figure 7:
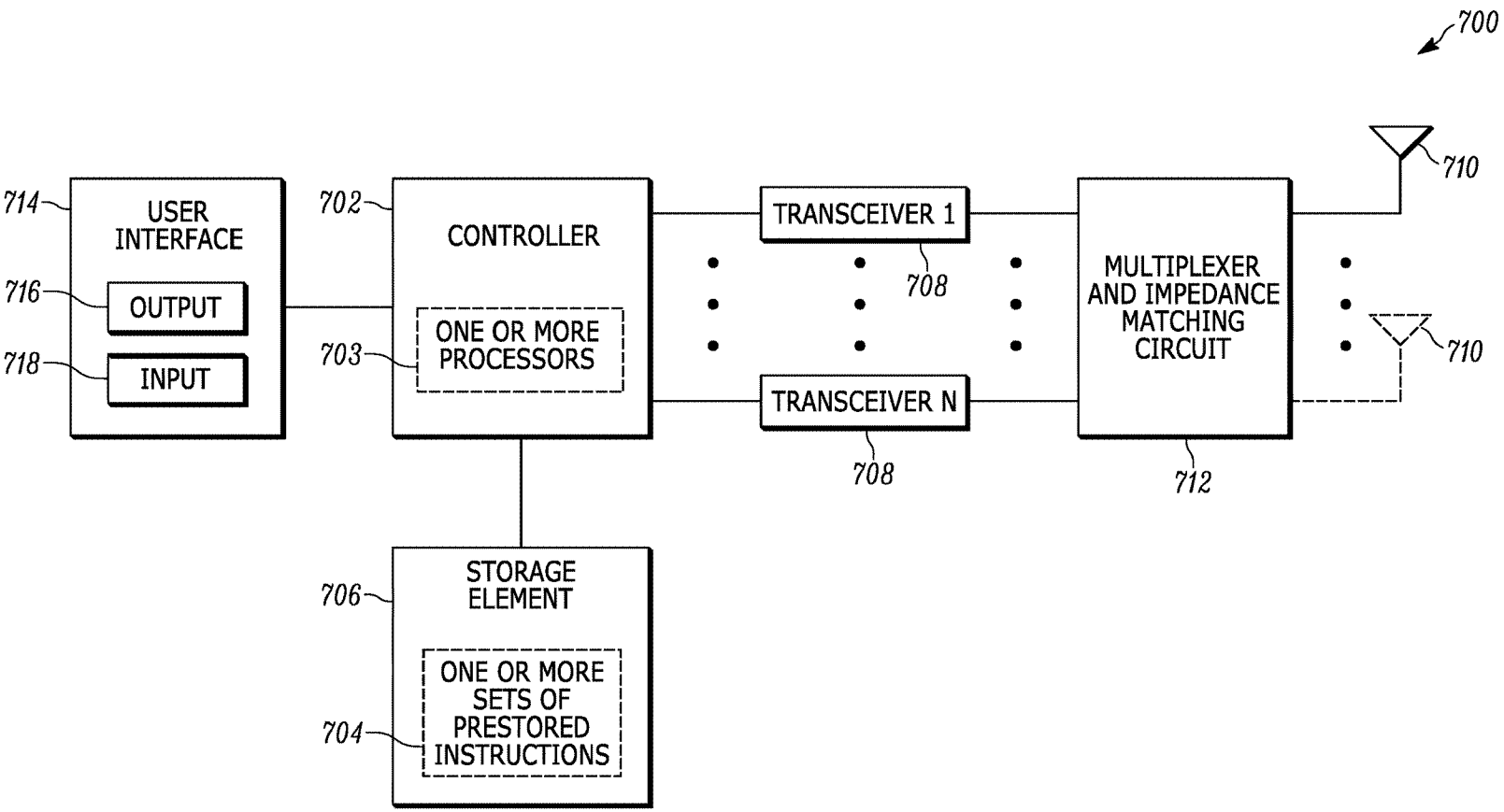
FIG. 7 is a block diagram of an exemplary wearable electronic device.

As noted previously, by using lugs 212 and 412 to mechanically couple the use location attachment 204 to the main body of the conductive housing 202, generally outside the main body, the space internal to the main body can be conserved for use by other elements, which support the intended functionality of wearable electronic device, such as electronic circuitry, power storage, and/or interface elements. FIG. 7 illustrates a block diagram 700 of an exemplary wearable device, such as a smart watch 106, in accordance with at least one embodiment. As noted previously, smart watches generally increasingly make use of wireless communications for extending interfacing, access and control of other nearby devices.

In the exemplary embodiment, illustrated, the wearable device can include a controller 702, which is adapted for managing at least some of the operation of the device. In some embodiments, the controller 702 could be implemented in the form of one or more processors 703, which are adapted to execute one or more sets of pre-stored instructions 704, which may be used to form, support, or implement the operation of at least part of one or more controller modules including those used to manage wireless communication. The one or more sets of pre-stored instructions 704 may be stored in a storage element 706, which while shown as being separate from and coupled to the controller 702, may additionally or alternatively include some data storage capability for storing at least some of the prestored instructions for use with the controller 702, that are integrated as part of the controller 702.

The storage element 706 could include one or more forms of volatile and/or non-volatile memory, including conventional ROM, EPROM, RAM, or EEPROM. The possible additional data storage capabilities may also include one or more forms of auxiliary storage, which is either fixed or removable, such as a hard drive, a floppy drive, a memory card, or a memory stick. One skilled in the art will still further appreciate that still other further forms of storage elements could be used without departing from the teachings of the present disclosure. In the same or other instances, the controller 702 may additionally or alternatively incorporate state machines and/or logic circuitry, which can be used to implement at least partially, some of the modules and/or functionality associated with the controller 702.

In the illustrated embodiment, the device further includes one or more transceivers 708, which are coupled to the controller 702 and which serve to manage the external communication of data including their wireless transmission and/or receipt using one or more forms of communications. In such an instance, the transceivers will generally be coupled to one or more antennas 710 via which the wireless communication signals will be radiated and received. For example, the one or more transceivers 708 might include a receiver for supporting communications with a global positioning system, one or more transceivers for supporting cellular radio frequency communications, a transceiver for supporting Bluetooth® type communications, a transceiver for supporting near field communications, as well as a transceiver for supporting Wi-Fi® type communications. Transceivers for other forms of communication are additionally and/or alternatively possible. While in some instances each transceiver can be associated with a separate antenna, it is envisioned that in the present instance an antenna may be able to support multiple transceivers and/or multiple forms of communication. As noted previously, the one or more antennas in at least some instance will be incorporated as part of the conductive housing.

In the present instance, the one or more transceivers 708 are coupled to at least one antenna 710 via a multiplexer and impedance matching circuit 712, which together can help to facilitate the multiple transceivers 708 interacting with the one or more antennas 710. The multiplexer portion of the circuit can support multiple transceivers being coupled to a common antenna. The impedance matching portion of the circuit can support the efficiency of power transfer between a transceiver 708 and a respective antenna 710 during the transmission and receipt of a wireless signal. The multiplexer portion of the circuit 712 can include various combinations of diplexers, triplexers and quadriplexers. Multiplexing can involve transmit and receive signal combining.

In the illustrated embodiment, the wearable device can additionally include user interface circuitry 714, some of which can be associated with producing an output 716 to be perceived by the user, and some of which can be associated with detecting an input 718 from the user. For example, the user interface circuitry 714 can include a display adapted for producing a visually perceptible output, which may further support a touch sensitive array for receiving an input from the user. The user interface circuitry may also include a speaker for producing an audio output, and a microphone for receiving an audio input. The user interface output 716 could further include a vibrational element. The user interface input 718 could further include one or more user actuatable switches 210, one or more sensors, as well as one or more cameras. Still further alternative and additional forms of user interface elements may be possible.

While preferred embodiments of the invention have been illustrated and described, it is to be understood that the invention is not so limited. For example, the present invention can be suitable for use with other types of wearable electronic devices in addition to the more specifically noted smart watch. Furthermore, in addition to a band type, use location attachment, still other forms of use location attachments are possible without departing from the teachings of the present inventions. For example, the links in the band could alternatively be links in a chain, which might be more suitable for wearing one or more types of wearable electronic devices about the neck of a user. Still further, some use location attachments may be suitable for attachment to something other than a person. Numerous further modifications, changes, variations, substitutions and equivalents will occur to those skilled in the art without departing from the spirit and scope of the present invention as defined by the appended claims.

What is claimed is:

1. A wearable electronic device adapted for supporting wireless radio frequency communications including at least one of generating or receiving a wireless radio frequency signal, the wearable electronic device comprising:

a conductive housing including a main body and at least a first pair of conductive lugs external to and mechanically coupled to the main body, where each of the conductive lugs has a first end that is mechanically coupled to the main body of the conductive housing and a second end which extends away from the main body along a length of the conductive lug, and where the main body of the conductive housing forms at least part of an antenna structure that is adapted for at least one of generating or receiving the wireless radio frequency signal;

a non-conductive pin, which extends between the second ends of the first pair of conductive lugs; and a use location attachment, which mechanically couples the conductive housing of the wearable electronic device to a use location via the non-conductive pin and the first pair of conductive lugs, the use location attachment including a plurality of segments, where at least one of the segments, which most closely mechanically couples to the non-conductive pin and the first pair of conductive lugs, is nonconductive, and where the other ones of the plurality of segments of the use location attachment are conductive;

wherein the plurality of segments includes a plurality of links, where each link includes a pair of side lobes separated by a cross member, the side lobes facilitating a coupling to a next adjacent link in the plurality of links; and wherein the non-conductive pin extends through the pair of side lobes and the cross member of the link corresponding to the non-conductive segment, which most closely mechanically couples to the non-conductive pin and the first pair of conductive lugs.

2. The wearable electronic device in accordance with claim 1, wherein the non-conductive pin is received within a hole, which extends through the segment of the plurality of segments of the use location attachment, which most closely mechanically couples to the non-conductive pin and the first pair of conductive lugs.

3. The wearable electronic device in accordance with claim 1, wherein the segment of the plurality of segments of the use location attachment, which most closely mechanically couples to the non-conductive pin and the first pair of conductive lugs, is at least partially covered by a metalized outer surface.

4. The wearable electronic device in accordance with claim 3, wherein the metalized outer surface includes a conductive sleeve.

5. The wearable electronic device in accordance with claim 3, wherein the metalized outer surface includes a non conductive vacuum metallization layer.

6. The wearable electronic device in accordance with claim 1, wherein the length of the lugs is of a sufficient distance to form a gap between the main body of the conductive housing and the segment of the plurality of segments of the use location attachment, which most closely mechanically couples to the non-conductive pin and the first pair of conductive lugs.

7. The wearable electronic device in accordance with claim 1, wherein the use location attachment is a wrist band.

8. The wearable electronic device in accordance with claim 1, wherein the cross member of the link, which most closely mechanically couples to the non-conductive pin and the first pair of conductive lugs, is non-conductive and includes a metalized surface; and wherein the side lobes of the non-conductive link have a width, which is adapted to reduce an amount that the associated cross member with the metalized surface will electromagnetically couple to the first pair of conductive lugs.

9. The wearable electronic device in accordance with claim 1, wherein the associated cross members of the links corresponding to the non-conductive segments are encapsulated by a metal sleeve.

10. The wearable electronic device in accordance with claim 1, wherein the non-conductive pin is received within a hole, which extends through the segment of the plurality of segments of the use location attachment, which most closely mechanically couples to the non-conductive pin and the first pair of conductive lugs, where the hole that receives the non-conductive pin extends through the associated side lobes of the segment most closely mechanically coupled to the non-conductive pin and the first pair of conductive lugs, as well as the associated cross member;

wherein the side lobes associated with the segment most closely mechanically coupled to the non-conductive pin and the first pair of conductive lugs each have a portion, which overhangs the associated cross member, and which partially overlaps a cross member of an adjacent segment in the plurality of segments of the use location attachment, that is further away from the first pair of conductive lugs, where a segment coupling pin extends through a cross member of the adjacent segment that is further away from the first pair of conductive lugs, and the overhang portion of the side lobes of the segment most closely mechanically coupled to the non-conductive pin and the first pair of conductive lugs through a separate set of holes in the overhang portion of the side lobes; and wherein the hole in the segment most closely mechanically coupled to the non-conductive pin and the first pair of conductive lugs, that receives the non-conductive pin, and the separate set of holes in the overhang portion of the side lobes for receiving the segment coupling pin are spaced a distance that precludes the cross member of the segment of the use location attachment, which most closely mechanically couples to the non-conductive pin and the first pair of conductive lugs, and the cross member of the adjacent segment that is further away from the first pair of conductive lugs from coming into direct physical contact.

11. The wearable electronic device in accordance with claim 1, where a link coupling pin, which is conductive, is used to mechanically couple together adjacent links.

12. The wearable electronic device in accordance with claim 1, wherein the conductive housing additionally includes a second pair of conductive lugs external to and mechanically coupled to the main body of the conductive housing, where each of the conductive lugs from the second pair has a first end that is mechanically coupled to the main body of the conductive housing and a second end which extends away from the main body along a length of the conductive lug.

13. The wearable electronic device in accordance with claim 12 further comprising a further non-conductive pin, which extends between the second ends of the second pair of conductive lugs.

14. The wearable electronic device in accordance with claim 13, wherein the plurality of segments of the use location attachment are additionally mechanically coupled to the main body of the conductive housing of the wearable electronic device via the further non-conductive pin and the second pair of conductive lugs.

15. The wearable electronic device in accordance with claim 14, wherein the plurality of segments of the use location attachment includes a further non-conductive segment, which most closely mechanically couples to the main body of the conductive housing via the further non-conductive pin and the second pair of conductive lugs.

16. The wearable electronic device in accordance with claim 1, wherein the plurality of segments of the use location attachment are divided into two sections of a plurality of segments, which are mechanically coupled together via a latch.

17. The wearable electronic device in accordance with claim 1, wherein the wearable electronic device is a smart watch device.

* * * * *